US008480811B2

(12) United States Patent
King

(10) Patent No.: US 8,480,811 B2
(45) Date of Patent: Jul. 9, 2013

(54) FILL PROTECTION ALGORITHM

(75) Inventor: Jonathan Duane King, Greenwood, MS (US)

(73) Assignee: Viking Range, LLC, Greenwood, MS (US)

( * ) Notice: Subject to any disclaimer, the term of this patent is extended or adjusted under 35 U.S.C. 154(b) by 238 days.

(21) Appl. No.: 13/109,321

(22) Filed: May 17, 2011

(65) Prior Publication Data

US 2011/0277794 A1 Nov. 17, 2011

Related U.S. Application Data

(60) Provisional application No. 61/345,272, filed on May 17, 2010.

(51) Int. Cl.
*B08B 7/04* (2006.01)

(52) U.S. Cl.
USPC ..... 134/18; 134/19; 134/25.2; 134/42; 134/56 D; 134/57 D; 134/58 D; 134/184; 134/186

(58) Field of Classification Search
USPC ..... 134/18, 19, 25.2, 42, 56 D, 57 D, 134/58 D, 184, 186
See application file for complete search history.

(56) References Cited

U.S. PATENT DOCUMENTS

| | | | | |
|---|---|---|---|---|
| 3,986,372 | A | 10/1976 | Karklys | |
| 4,097,307 | A | 6/1978 | Geiger | |
| 4,241,400 | A | 12/1980 | Kiefer | |
| 4,481,786 | A | 11/1984 | Bashark | |
| 5,265,446 | A | 11/1993 | Kuroda et al. | |
| 5,284,523 | A | 2/1994 | Badami et al. | |
| 5,330,580 | A | 7/1994 | Whipple, III et al. | |
| 5,722,263 | A | 3/1998 | Tassotti | |
| 6,887,318 | B2 | 5/2005 | Bashark | |
| 2004/0099287 | A1 | 5/2004 | Shin | |
| 2006/0207632 | A1 | 9/2006 | Lee | |
| 2006/0219262 | A1 | 10/2006 | Peterson et al. | |
| 2007/0151579 | A1 | 7/2007 | Hooker et al. | |
| 2007/0181156 | A1 | 8/2007 | Uz et al. | |
| 2008/0255977 | A1 * | 10/2008 | Altberg et al. | 705/35 |
| 2008/0314410 | A1 * | 12/2008 | Choi et al. | 134/18 |
| 2009/0056773 | A1 | 3/2009 | Son et al. | |
| 2009/0133719 | A1 | 5/2009 | Park | |
| 2010/0043844 | A1 * | 2/2010 | Han et al. | 134/102.1 |
| 2011/0277794 | A1 * | 11/2011 | King | 134/18 |

* cited by examiner

*Primary Examiner* — Bibi Carrillo

(74) *Attorney, Agent, or Firm* — Baker Donelson; Dorian B. Kennedy

(57) ABSTRACT

A fill protection algorithm for determining whether the water level in a dishwasher is sufficient to enable operation of the wash pump of the dishwasher without burn-out or other damage to the wash pump and/or heating element of the dishwasher due to insufficient water level. A change in water temperature $TEMP_{DELTA}$ is detected and is compared to a predetermined water temperature change level or amount, $TEMP_{MIN_DELTA}$, and if the detected change in water temperature $TEMP_{MIN_DELTA}$ is greater than or equal to the minimum water temperature change $TEMP_{MIN_DELTA}$, operation of the dishwasher is allowed to proceed.

14 Claims, 2 Drawing Sheets

FILL PROTECTION ALGORITHM

CROSS REFERENCE TO RELATED APPLICATION

The present patent application is a formalization of previously filed, U.S. Provisional Patent Application Ser. No. 61/345,272, filed May 17, 2010 by the inventor named in the present Application. This patent application claims the benefit of the filing date of this cited Provisional Patent Application according to the statutes and rules governing provisional patent applications, particularly 35 U.S.C. §119(a)(i) and 37 C.F.R. §1.78(a)(4) and (a)(5). The specification and drawings of the Provisional Patent Application referenced above are specifically incorporated herein by reference as if set forth in their entirety.

FIELD OF THE INVENTION

The present disclosure generally relates to a method of determining if water enters a dishwasher. More specifically, the present disclosure relates to an algorithm to prevent seal damage to a wash pump for a dishwasher.

BACKGROUND OF THE INVENTION

Conventional wash pumps for dishwashers and similar appliances generally require water to be present to lubricate the seals to prevent seal damage from the excessive heat generated by running dry. A dry run could be caused by a variety of scenarios, such as failing to turn on the water to the dishwasher after initial installation or such as a sudden unexpected loss of water pressure. As a result, the motor of the pump and/or the heating element for the dishwasher can overheat and burn out, requiring costly repairs to replace these components. Some conventional dishwashers determine the presence of water in a dishwasher by using a flow meter, pressure sensor, or other device provided specifically for water management. Such additional parts increase the cost of the dishwasher and generally require a flow of water coming into the dishwasher to operate. Accordingly, it can be seen that a need exists for a system and method for detection of water within a dishwasher that addresses the foregoing and other related and unrelated problems in the art.

SUMMARY

The invention utilizes an existing part in a novel manner to detect the presence of water. The present invention generally includes a thermistor to detect a water fill. Although thermistors are generally provided in conventional dishwashers, such as to manage heating of water, such conventional thermistors are not used for water management, especially for minimum water level determination. The present algorithm accordingly utilizes a temperature measuring or monitoring device such as a thermistor, for example, to determine whether the proper amount of water has been provided in a dishwasher.

To analyze whether the proper amount of water is present, the algorithm compares a change in temperature, $TEMP_{DELTA}$ with a $TEMP_{MIN_DELTA}$ during a first fill sequence. If $TEMP_{DELTA} < TEMP_{MIN_DELTA}$, the dishwasher control will be alerted that a sufficient water level is not detected. If $TEMP_{DELTA} \geqq TEMP_{MIN_DELTA}$, the dishwasher control will be alerted that a sufficient water level is detected. If water is detected, the algorithm proceeds with subsequent motor current tests. Subsequent motor current tests can include, for example, time measurements of current through the pump motor to ensure sufficient water level flow for continued operation of the dishwasher. If a sufficient water level is not detected in the first fill sequence, the algorithm executes a drain sequence and the dishwasher operation is aborted. Prior to initiation of the drain sequence, the detection parameters generally are reset and are monitored during the drain sequence. If water is detected during the drain sequence, the algorithm initiates a second fill sequence without requiring additional temperature detection and then the algorithm proceeds with subsequent motor current tests.

If water is not detected during either the first fill sequence or the drain sequence, the algorithm initiates a retry fill sequence. Prior to the retry fill sequence, the detection parameters generally are first reset, then are monitored during the retry fill sequence. If water is detected during the retry fill sequence, the algorithm proceeds with subsequent motor current tests. If water is not detected during the initial fill sequence, or the drain sequence, or the retry fill sequence, the algorithm proceeds to drain the dishwasher unit and indicates a Fill Error.

Generally, since the temperature expectedly changes upon a successful water detection, the algorithm specified above is used for the first fill sequence, and, if required, during drain/retry fill sequence, of a dishwasher operation cycle.

Those skilled in the art will appreciate the above stated advantages and other advantages and benefits of various additional embodiments upon reading the following detailed description of the embodiments with reference to the below-listed drawing figures.

According to common practice, the various features of the drawings discussed below are not necessarily drawn to scale. Dimensions of various features and elements in the drawings may be expanded or reduced to more clearly illustrate the embodiments of the disclosure.

DETAILED DESCRIPTION

The present invention includes an algorithm designed to prevent activation of a dishwasher motor or flow through heater unless a water level sufficient to prevent component damage is present in the dishwasher. The present invention utilizes a thermistor or other temperature detection component to detect a change in the temperature of any water present in the dishwasher. Generally, the algorithm monitors and/or measures a change in temperature to detect/determine whether a fill step has been complete. If sufficient water is determined to have been provided during the fill step, the algorithm proceeds with the dishwasher operation cycle. Otherwise, a drain cycle is initiated, and then a subsequent fill cycle can be initiated. A change in temperature of the water within the dishwasher is monitored through each cycle.

Figure 1:
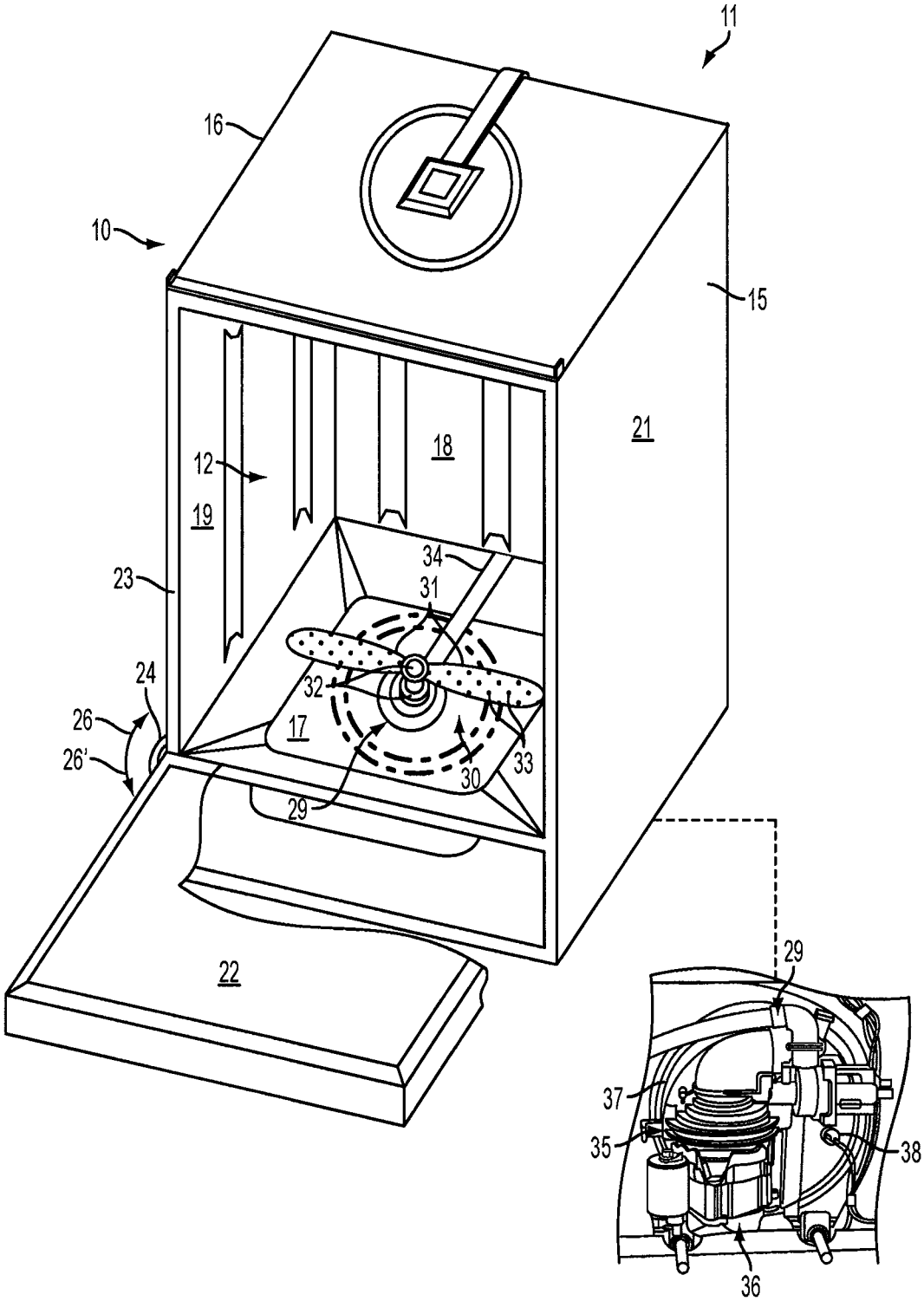
FIG. 1 is a perspective view of a dishwasher for use with the method of the present invention, with parts broken out for clarity.

As illustrated in FIG. 1, the dishwasher 11 generally includes a cabinet 15 having a top wall 16, a bottom 17, a rear wall 18, and side walls 19 and 21. The top, bottom, rear and side walls of the cabinet define the open ended wash chamber or tub 12 in which dishes are received, typically on racks (not shown) for cleaning. A door 22 generally is pivotally mounted to the open front side 23 of the dishwasher cabinet 15, such as by hinges 24 (only one of which is shown for clarity). The door 22 thus is pivotable as indicated by arrows 26/26' so as to move the door from an open position for loading dishes within the wash chamber, as generally illustrated in FIG. 1, to a closed position covering the front side 23 of the dishwasher cabinet 15 for sealing the wash chamber during a cleaning cycle. As further indicated in FIG. 1, the bottom 17 of the dishwasher chamber 15 can include sloped or inwardly tapering walls 27, which typically slope downwardly toward a drain 28 for a sump and motor assembly, indicated by phantom lines 29 in FIG. 1 at the bottom or base of the dishwasher within the dishwasher cabinet. The sloping walls collect and direct water into the drain for removal from the wash chamber 12.

At least one spray arm 30 typically is mounted within the wash chamber for applying heated water and cleaning solutions of water and soap against the dishes during wash and rinse cycles of the cleaning operation. While only one spray arm 30 is illustrated in FIG. 1, it will be understood by those skilled in the art that additional spray arms can be utilized, mounted along an inner surface or side of the top 16 of the cabinet or in other various positions as needed. The spray arm 30 generally includes two or more sections or ends 31 that extend radially outwardly from a central hub 32 and include a series of spray openings 33 formed at spaced locations therealong and through which the water and/or cleaning solution is sprayed against the dishes. The spray openings further can be aligned or oriented at varying angles to cover a desired spray area.

The spray arm 30 generally is connected via a water line or pipe 34 to a wash pump 35, which is part of the sump and motor assembly 29 and can include or can be connected to a motor 36, and a heater 37, such as a flow-through heater or similar heating element. A thermistor 38 or similar temperature sensing device additionally is located along the sump and motor assembly 29 adjacent the wash pump. The wash pump supplies heated water and/or cleaning solution to the spray arm(s) under pressure, generally causing the spray arm to rotate for application of sprays of heated water and/or cleaning and rinse solutions against the dishes during washing and rinsing cycles of the cleaning operation. The thermistor monitors the temperature of water within the sump and provides feedback to a control system for the dishwasher regarding changes in the temperature of the water present in the sump and water assembly, which the fill protection algorithm according to the present invention utilizes to determine the presence of a level of water within the sump and motor assembly sufficient to initiate operation of the wash pump 35 with the danger of overheating or the pump running "dry" being substantially minimized.

Figure 2:
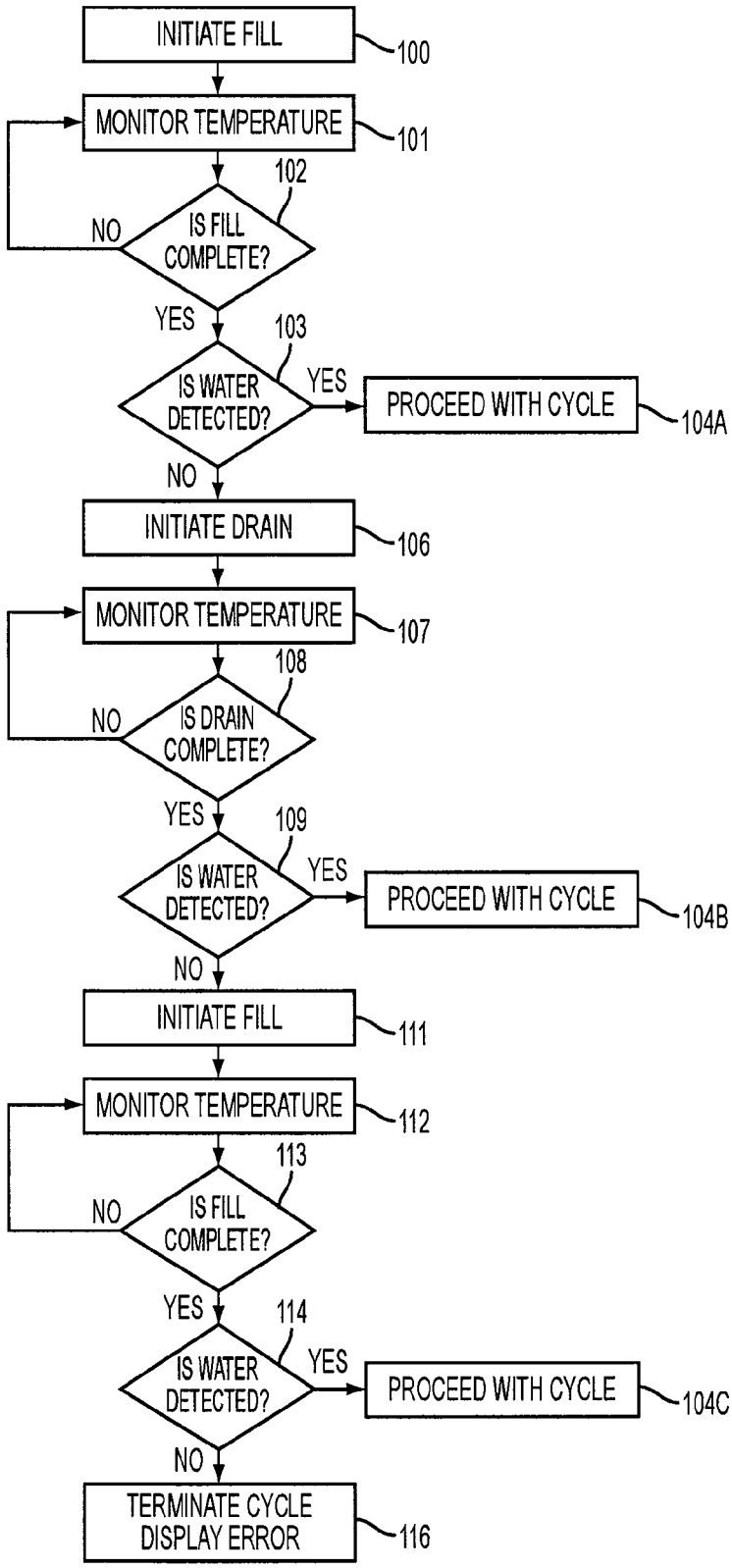
FIG. 2 shows a flowchart illustrating a method for monitoring temperature in a dishwasher according to the present invention.

FIG. 2 schematically illustrates the fill protection algorithm that operates in conjunction with the initiation of a dishwasher operational cycle to prevent activation of the dishwasher motor and/or flow-through heater element without a sufficient level of water being present in the dishwasher sump to prevent component damage such as overheating or deterioration of seals from lack of a sufficient level of water within the wash pump and sump and motor assembly of the dishwasher. In an initial step 100, the dishwasher operation is initiated with the start of a first filling sequence. As the first fill sequence is initiated and proceeds, the thermistor or similar sensor monitors and reports the temperature of the water within the sump and motor assembly to the control system of the dishwasher, which will determine a change in temperature ($TEMP_{DELTA}$), as indicated at step 101, based on the feedback of reported/detected temperature provided by the thermistor. The fill sequence can be run as a timed sequence, with the filling of the dishwasher generally continued for a preset time until completion, as indicated at 102. Once the first fill cycle is or should be at least substantially completed, a determination is made as to whether there is a sufficient level of water within the sump and motor assembly to proceed with the dishwasher operational cycle.

The following parameters are measured throughout the first fill sequence:

| Parameter | Description |
|---|---|
| $TEMP_{MAX}$ | Maximum temperature |
| $TEMP_{MIN}$ | Minimum temperature |
| $TEMP_{DELTA}$ | Difference between $TEMP_{MAX}$ and $TEMP_{MIN}$ |
| $TEMP_{MIN_DELTA}$ | The minimum temperature change required to indicate that enough water has entered the system to prevent motor damage from running "dry". |

In general, the fill protection algorithm according the principles of the present invention is based upon a change in temperature of the water within the sump and motor assembly. Generally, as water flows into the sump and motor assembly, there will be a change in temperature due to the incoming water. This change in temperature is indicative of an inflow of water, and if the monitored or detected change in temperature is determined to be at a level at or above the predetermined $TEMP_{MIN_DELTA}$, the control system for the dishwasher is able to determine that there exists a sufficient level of water within the sump and motor assembly of the dishwasher to enable its operation without damage to the wash pump and/or the flow-through heater of the dishwasher. This $TEMP_{MIN_DELTA}$ further is set so that a dishwasher will operate with at least a minimum level of water necessary to enable pump operation without causing damage to the seals or burnout of the pump.

In order to detect whether a sufficient level of water is present in the sump and motor assembly to initiate the dishwasher operational cycle, the fill protection algorithm monitors the change in temperature ($TEMP_{DELTA}$) between a first measured temperature, which typically can include an initial or minimum temperature ($TEMP_{MIN}$) and a second measured temperature, generally measured at a desired or selected time during or at/close to the end of the sequence and which can include a maximum measured temperature ($TEMP_{MAX}$), to determine a change in temperature from the start of the filling operation until the perceived or timed completion of the first fill sequence. This change in temperature ($TEMP_{DELTA}$) is compared (step 103) with a predetermined minimum temperature change that is selected or predetermined as indicative of there being sufficient water within the system to prevent motor damage from running "dry" ($TEMP_{MIN_DELTA}$). If the $TEMP_{DELTA}$ is detected as being greater than or equal to the prescribed $TEMP_{MIN_DELTA}$, the dishwasher operation is engaged and the dishwasher cycle is allowed to proceed, as indicated at 104A. If the $TEMP_{DELTA}$ is less than the $TEMP_{MIN_DELTA}$, that is generally indicative of there being an insufficient amount of water coming into the sump and motor assembly to ensure operation of the wash pump and activation of the flow-through heater or other heating element without creating a potentially damaging condition such as running dry and/or without the heating element becoming overheated and thus tripping a circuit breaker or similar fail switch that will shut down operation of the heating element.

As indicated in FIG. 2, if an insufficient level of water is detected at step 103, the algorithm initiates a drain sequence at 106. During this drain sequence, the thermistor continues to monitor a change in temperature of the water within the dishwasher, as indicated at 107, to determine whether the drain sequence has been completed (step 108). Once the drain sequence is completed, generally based upon a timed cycle for the drain sequence or other indicator, the wash pump motor can be activated for a brief time period during which the current load on the motor is monitored to determine maximum and minimum current to determine if the water has been fully drained, based upon a no-load condition detected for the motor, and, if not, the dishwasher control system can be alerted to signal an error condition. In addition, if the water has been successfully drained, the algorithm via the thermistor can check the change in temperature of the water within the sump and motor assembly upon completion of the drain sequence and determines whether there is sufficient presence of water within the sump and motor assembly to begin the dishwasher operational cycle, as indicated at 109. If a sufficient level of water is detected, the dishwasher operational cycle can be allowed to proceed as indicated at 104B and an initial operation of the wash pump is begun.

If a sufficient level of water is not detected within the sump and motor assembly, the algorithm can initiate a second or retry fill sequence, as indicated at 111 in FIG. 2. As indicated at 112, the change in temperature of the incoming water flow until completion of the second or retry fill sequence (step 113), and will compare the monitored $TEMP_{DELTA}$ to the prescribed $TEMP_{MIN_DELTA}$, as indicated at 114. If the $TEMP_{DELTA}$ is less than the monitored $TEMP_{MIN_DELTA}$, the dishwasher control system will again determine or be alerted that an insufficient level of water is still detected/found in the sump and motor assembly, after which the dishwasher control system can block or shut down any further operation of the dishwasher and display an error code or otherwise indicate a "Fill Error." At the same time, the dishwasher control system can initiate a drain sequence to drain any residual water from the dishwasher, as indicated at 116. Alternatively, if the $TEMP_{DELTA}$ is greater than or equal to the $TEMP_{MIN_DELTA}$, indicating a sufficient level of water for a safe start to the operation of the wash pump, the dishwasher control system can initiate the operational cycle for the dishwasher, as indicated at 104C.

Once the dishwasher cycle has been initiated, the wash pump will be started or engaged and will begin to pump water through the dishwasher and to the spray arms for application to the dishes within the dishwasher. As the pump is operated, the motor current for the pump motor further will be monitored to determine the continued presence of a sufficient amount of water within the system to keep the pump operating at a desired or optimum level and without damage to the pump and/or flow-through heater element, based upon the motor current detected over a predetermined window of time of operation. Average motor current will be checked to determine if the motor is in a no-load (absence of water) or loaded condition, as well as to check the difference between maximum and minimum monitored current to determine if the motor of the wash pump is surging. If the motor is found to be loaded and not surging, the dishwasher operation cycle can proceed. If the motor is indicated as in a no-load condition or is surging, the dishwasher control system can stop operation and indicate an error condition.

The foregoing description of the disclosure illustrates and describes various embodiments. As various changes could be made in the above construction without departing from the scope of the disclosure, it is intended that all matter contained in the above description or shown in the accompanying drawings shall be interpreted as illustrative and not in a limiting sense. Furthermore, the scope of the present disclosure covers various modifications, combinations, alterations, etc., of the above-described embodiments that are within the scope of the claims. Additionally, while the disclosure shows and describes only selected embodiments of the present invention, the present invention is further capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment of the present invention may be selectively interchanged and applied to other illustrated and non-illustrated embodiments of the invention.

What is claimed is:

1. A method of controlling operation of a dishwasher, comprising determining a minimum change in temperature of water within the dishwasher, $TEMP_{MIN_DELTA}$, indicative of a level of water present in the dishwasher to initiate operation of a wash pump thereof;

initiating a fill sequence for filling the dishwasher with water for operation of the dishwasher;

monitoring a change in temperature, $TEMP_{DELTA}$, of the water within the dishwasher during the fill sequence;

comparing the $TEMP_{DELTA}$ to the $TEMP_{MIN_DELTA}$;

if the $TEMP_{DELTA}$ is greater than or equal to the $TEMP_{MIN_DELTA}$, initiating operation of the wash pump; and if the $TEMP_{DELTA}$ is less than the $TEMP_{MIN_DELTA}$, initiating a drain sequence for the dishwasher.

2. The method of claim 1 and further comprising:

initiating a retry fill sequence after completion of the drain sequence, monitoring a change in temperature, $TEMP_{DELTA}$, of the water within the dishwasher;

comparing the $TEMP_{DELTA}$ to the $TEMP_{MIN_DELTA}$;

if the $TEMP_{DELTA}$ is greater than or equal to the $TEMP_{MIN_DELTA}$, initiating operation of the wash pump; and if the $TEMP_{DELTA}$ is less than the $TEMP_{MIN_DELTA}$, initiating a drain sequence for the dishwasher.

3. The method of claim 1 and wherein after initiating operation of the wash pump, monitoring a current flow in a motor of the wash pump to determine whether a sufficient flow of water is passing through the wash pump for continued operation thereof without damage to the wash pump.

4. The method of claim 1 and wherein monitoring a change in temperature, $TEMP_{DELTA}$, of the water in the dishwasher comprises detecting a first temperature of the water prior to initiating the fill sequence, and detecting a second temperature after initiation of the fill sequence.

5. The method of claim 1 and further comprising monitoring a change in temperature during the drain sequence to detect presence of water, and if water is detected, initiating a second fill sequence and begin operation of the wash pump.

6. The method of claim 2 and further comprising terminating operation of the dishwasher if the $TEMP_{DELTA}$ is less than the $TEMP_{MIN_DELTA}$ after initiating the retry fill sequence, and indicating an error condition.

7. The method of claim 4 and wherein the second temperature is detected after a conclusion of the fill sequence.

8. The method of claim 4 and wherein the first temperature comprises a minimum monitored temperature of the water, and the second temperature comprises a maximum monitored temperature of the water detected after a conclusion of the fill sequence.

9. The method of claim 5 and wherein if water is not detected during the drain sequence, terminating operation of the dishwasher and indicating an error condition.

10. The method of claim 5 and wherein after initiating operation of the wash pump, monitoring a current flow in a motor of the wash pump to determine whether a sufficient flow of water is passing through the wash pump for continued operation thereof without damage to the wash pump.

11. A method of controlling operation of a dishwasher, comprising determining a minimum change in temperature of water within the dishwasher, $TEMP_{MIN_DELTA}$, indicative of a level of water present in the dishwasher to initiate operation of a wash pump thereof;

initiating a fill sequence for filling the dishwasher with water for operation of the dishwasher;

monitoring a change in temperature, $TEMP_{DELTA}$, of the water within the dishwasher during the fill sequence;

comparing the $TEMP_{DELTA}$ to the $TEMP_{MIN_DELTA}$;

if the $TEMP_{DELTA}$ is greater than or equal to the $TEMP_{MIN_DELTA}$, initiating operation of the wash pump;

if the $TEMP_{DELTA}$ is less than the $TEMP_{MIN_DELTA}$, initiating a drain sequence for the dishwasher;

as the water is drained, monitoring a change in temperature of the water draining during the drain sequence; and if the monitored change in temperature of the water drained during the drain sequence is greater than or equal to the minimum change in temperature $TEMP_{MIN_DELTA}$, completing the drain sequence and initiating a second fill sequence for operation of the dishwasher.

12. The method of claim 11 and wherein:

if the monitored change in temperature of the water drained during the drain sequence is less than the minimum change in temperature $TEMP_{MIN_DELTA}$, completing the drain sequence;

initiating a retry fill sequence after completion of the drain sequence, monitoring a change in temperature, $TEMP_{DELTA}$, of the water within the dishwasher;

comparing the $TEMP_{DELTA}$ to the $TEMP_{MIN_DELTA}$;

if the $TEMP_{DELTA}$ is greater than or equal to the $TEMP_{MIN_DELTA}$, initiating operation of the wash pump; and if the $TEMP_{DELTA}$ is less than the $TEMP_{MIN_DELTA}$, initiating a drain sequence for the dishwasher.

13. The method of claim 11 and wherein after initiating operation of the wash pump, monitoring a current flow in a motor of the wash pump to determine whether a sufficient flow of water is passing through the wash pump for continued operation thereof without damage to the wash pump.

14. The method of claim 12 and further comprising terminating operation of the dishwasher if the $TEMP_{DELTA}$ is less than the $TEMP_{MIN_DELTA}$ after initiating the retry fill sequence, and indicating an error condition.

* * * * *